United States Patent [19]

Mashaw, Jr.

[11] 4,448,427

[45] May 15, 1984

[54] PISTON-EXPANDED METALLIC SEAL FOR SIDE DOOR WELL VALVE

[75] Inventor: Howard R. Mashaw, Jr., The Colony, Tex.

[73] Assignee: Otis Engineering Corporation, Dallas, Tex.

[21] Appl. No.: 503,173

[22] Filed: Jun. 10, 1983

[51] Int. Cl.[3] ..... F16J 15/40; E21B 23/00

[52] U.S. Cl. ..... 277/73; 277/12; 277/125; 277/236; 166/118; 166/332

[58] Field of Search ..... 277/12, 73, 30–32, 277/116.2, 116.4, 116.6, 116.8, 120, 125, 116, 117, 236; 166/118–123, 117.6, 332

[56] References Cited

U.S. PATENT DOCUMENTS

| | | | |
|---|---|---|---|
| 3,051,243 | 8/1962 | Grimmer et al. | 166/332 |
| 3,200,837 | 8/1965 | Brown | 277/73 X |
| 3,208,532 | 9/1965 | Chenoweth | 277/73 X |
| 3,375,013 | 3/1968 | Grantom | 277/73 X |
| 4,288,082 | 9/1981 | Setterberg | 277/125 |
| 4,415,038 | 11/1983 | Schmuck | 166/332 X |

*Primary Examiner*—Robert S. Ward

*Attorney, Agent, or Firm*—Vinson & Elkins

[57] ABSTRACT

A valve having a lead seal for controlling flow through a port in the housing of the valve in which the seal is moved from an out of the way position into a position preventing flow through the port. The seal is metallic and by using a piston-type seal expander in combination with a ball catcher pressure exerted within the valve on a ball may be exerted over the entire area defined by the piston to set the seal under very high pressures, after which the ball and its catching tube may be released from the piston and removed from the valve.

8 Claims, 6 Drawing Figures

PISTON-EXPANDED METALLIC SEAL FOR SIDE DOOR WELL VALVE

This invention relates to valves, and more particularly to valves of the type in which flow through a port in the side wall of the housing is controlled.

In many instances it is desirable in the completion of a well to utilize a side door valve to permit flow through the valve during completion operations and then to seal off and prevent flow through the valve. For a discussion of this general type of valve and its uses, see Grimmer U.S. Pat. No. 3,051,243.

Wells may be completed with such a side door valve desirably located in a high temperature area or exposed highly acidic well fluids. In either of these instances a metallic seal which can readily withstand the high temperature or acid service is desirable. Metallic seals have been used for various purposes, such as sealing between a casing and a tubing run into the casing which carries on its lower end a metallic seal that is expanded between the tubing and casing to seal therebetween. See Setterberg U.S. Pat. No. 4,288,082.

A side door valve utilizing a metallic seal for acid or high temperature service has not been available and it is the principal object of this invention to provide such a valve.

Another object is to provide a valve in which a metallic seal is located in an out of the way position during flow through ports in the housing of the valve and when circulation through such ports is no longer desired the metallic seal is moved under pressure to engage a stop and expanded to seal against flow through such ports.

Another object is to provide a valve having a metallic seal as in the preceding objects in which the seal is protected prior to being used by an internal tubular protector which may be a part of the internal tube against which the seal is expanded when in final position, or may be separate from such tube and engage the end of the tube as the seal is moved to its final sealing position to protect the seal prior to use and in moving from its out of the way to its sealing position.

Another object is to provide a valve utilizing a metallic seal with teeth which engage the interior and the exterior of an annular metallic seal member to provide a labyrinth-type seal therebetween.

Another object is to provide a valve utilizing a metallic seal which is expanded by a piston in which the seal and piston are releasably latched in non-sealing position while the valve is in open position.

Another object is to provide a valve as in the preceding object in which separate latches are utilized so that the latch for locating the metal seal may be easily released by a small force.

Another object is to provide a valve utilizing a metallic seal in which when the valve is expanded by an expansion piston, the piston is locked in position holding the metallic seal in its expanded position.

Another object is to provide a valve with a metal seal which is expanded by a piston with a catcher tube which is releasably and sealingly latched to the piston so that a plug, such as a ball, may be dropped into the valve and seat against the catcher tube to permit pressure to be applied over the entire area defined by the piston to obtain a large force to expand the metallic seal.

Other objects, features and advantages of the invention will be apparent from the drawing, the specification and the claims.

In the drawings wherein illustrative embodiments of the invention are shown and wherein like reference numerals indicate like parts:

Figure 1:
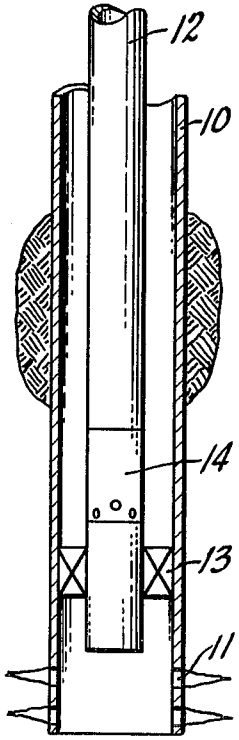
FIG. 1 is a schematic illustration of the lower end of a petroleum well utilizing a valve of this invention.
Figure 5A:
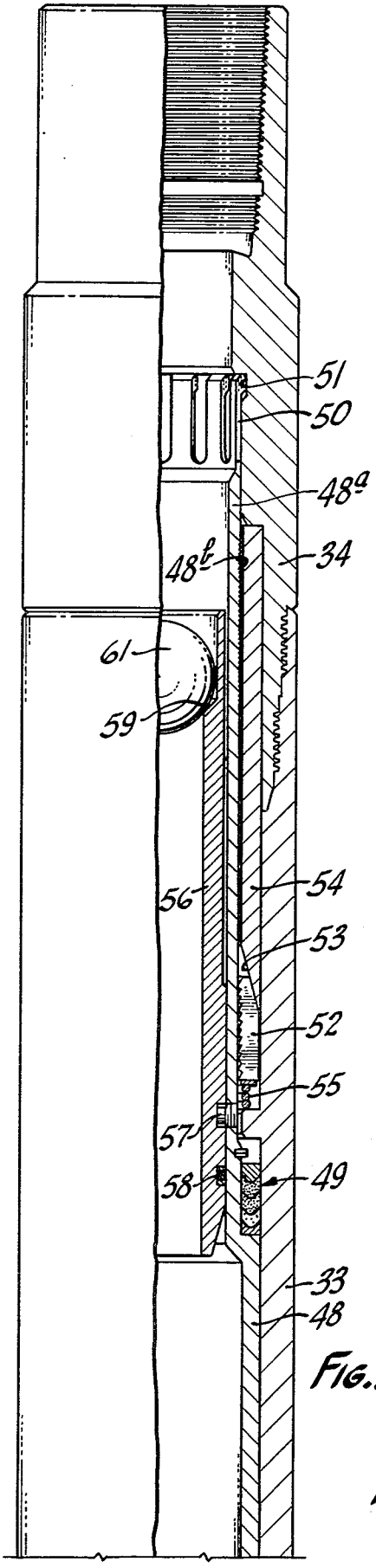
FIGS. 5A and 5B are continuation quarter-section views of a valve constructed in accordance with this invention.
Figure 5B:
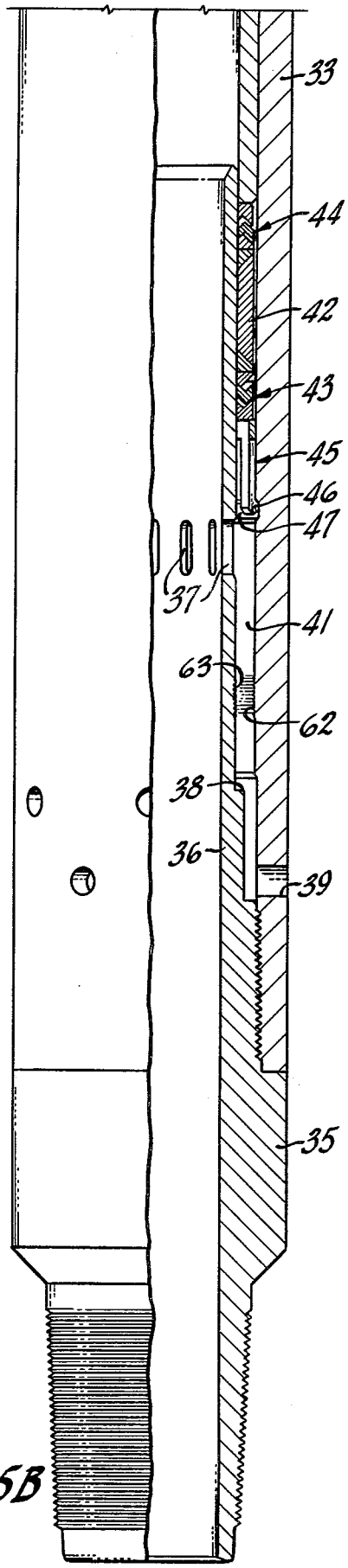

In FIG. 1 the lower section of a well is shown to include casing 10 having perforations 11 into the well formation. A tubing 12 is suspended in the well and packer 13 seals between the casing and tubing. A side door valve indicated generally at 14 initially provides for circulation between the tubing and the casing-tubing annulus. After circulation operations are completed, the valve is permanently closed.

Figure 2:
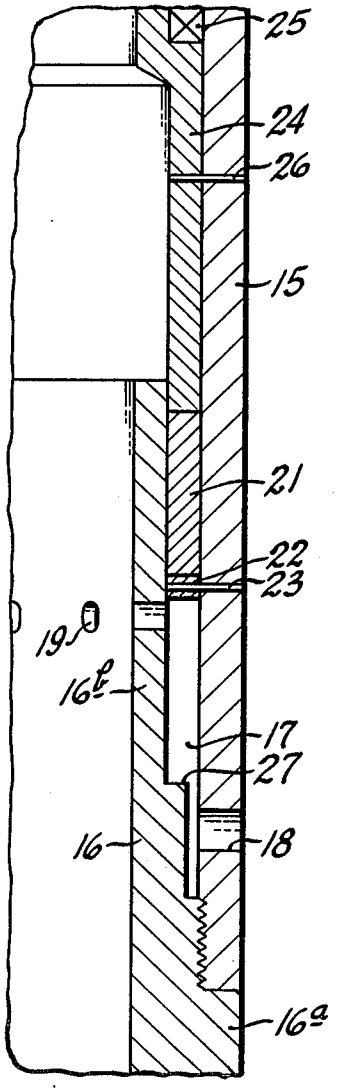
FIG. 2 is a schematic cross-section through a fragment of a valve illustrating this invention.

Reference is made to FIG. 2 which shows schematically the preferred form of this invention. The valve has a housing 15 which may be made up as a part of the tubing, as illustrated in FIG. 1. Within the tubular housing 15 there is provided a tube means 16 which has one end fixed in the housing. As shown in FIG. 2, the end **16*a* may form the bottom sub for housing 15, if desired. The upper end 16*b* of the tube means 16 is spaced radially inward from the housing to provide an annulus 17**.

The housing 15 has port means provided by a plurality of holes 18 in the wall of the housing communicating the exterior of the housing with the annulus 17.

To provide for flow through the valve via the port means 18 and the annulus 17 flowway means is provided by the holes 19 in the tube 16 which communicate the annulus 17 with the interior of the tube 16. This flow communication between the ports 18 and holes 19 via annulus 17 provides for flow from the exterior of the valve to the interior of the valve to circulate fluid between the tubing and the casing-tubing annulus of a well, as illustrated in FIG. 1.

Metallic seal means 21 is slidably carried in the housing and moves from the first position shown in FIG. 2 which is spaced from the annulus between the port means 18 and the flowway means 19 to a second position in the annulus between the port means and the flowway means. When in this second position the metallic seal means 21 when expanded will interrupt flow between the ports 18 and the flowway holes 19 and permanently close the ports 18.

As the seal means 21 is to be expanded under high pressure, a backup ring is carried in the housing below the seal means.

To insure that the seal means 21 remains in the position shown in FIG. 2 until it is desired to expand the seal, a releasable means is provided by the shear pin 23 which pins backup ring 22 to the housing and prevents sliding of the seal means in the housing until the pin is sheared thus supporting the seal in the out of the way position shown.

A piston 24 having a sliding seal 25 with the housing is provided for moving the seal means 21 from the first out of the way position to the second position in the annulus 17. Any desired means may be utilized to drive the piston downwardly to move the seal 21 into the annulus 17. Preferably, the seal 25 is made responsive to pressure fluid within the tubing 12 to drive the piston down, but it will be appreciated that any other means, such as those well known to set packers may be utilized to dive the piston 24 downwardly.

To support the piston 24 in the raised position shown, a releasable means is provided which releasably prevents sliding of the piston means downwardly until the piston 24 is subjected to the desired downward force. Such a means may be provided by the shear pin 26 pinning the piston to the housing 15. It is preferable to have separate pins pinning the piston to the housing and the seal to the housing so that a very light releasable means may be utilized to support the seal which may be released by downward movement of the seal without any substantial expansion of the seal.

For supporting the backup ring 22 and the seal 21 while being expanded a stop 27 is provided in the annulus.

In operation of the valve of FIG. 2 pressure is applied to the piston 24 to shear the pin 26 and drive the seal 21 downwardly, which in turn shears the pin 23. The seal is moved downwardly to a position where the backup ring 22 rests upon the stop 27 and continued downward movement of the piston expands the metallic seal 21 into engagement with the inner diameter of the housing and the outer diameter of the tube 16 in the annulus 17 and prevents flow through the ports 18.

Figure 3:
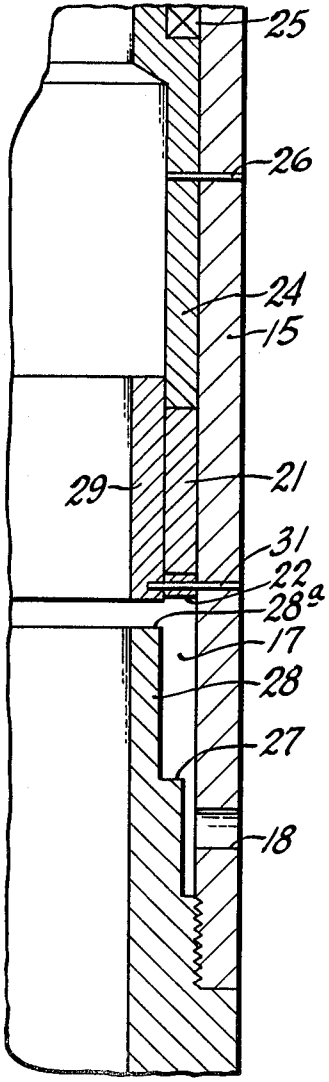
FIG. 3 is a view similar to FIG. 2 illustrating another form of this invention.

A modified form of the valve is shown in FIG. 3. In this valve the tube 28 is substituted for the tube 16 and the upper end of the tube 28 terminates at 28*a* which is approximately the same level as the ports 19 in the tube 16 and flow from the annulus 17 passes into the interior of the valve and tubing by passing the upper end of the tube 28.

An annular protector tube or ring 29 is pinned to the housing utilizing a longer shear pin 31 which pins the annular protector and the backup ring to the housing.

In closing of the FIG. 3 form of the invention, downward movement of the piston 24 shears the pin 31 between the housing and the backup ring 22 and permits the seal 21 and the protector tube 29 to move downwardly as a unit until the lower end of the protector ring 29 engages the upper end 28*a* of the tube means. Continued downward movement of the piston will then shear the pin 31 between the backup ring 22 and the protector tube 29 and permit the seal 21 to be forced into the annulus 17 and seal therein, as above explained. The protector tube 29 when it engages the upper end of the tube means provides a continuation thereof just prior to movement of the seal means into the annulus to insure smooth movement of the seal into the annulus.

Figure 4:
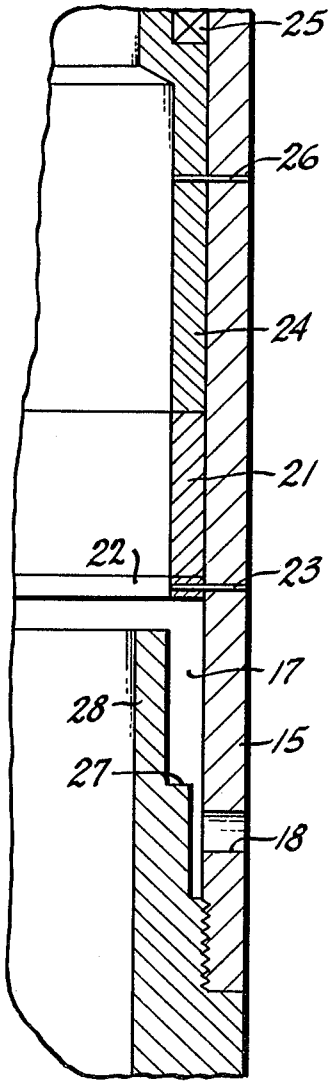
FIG. 4 is a view similar to FIG. 3 illustrating another form of this invention.

FIG. 4 shows a still further form of this invention in which the seal 22 is unprotected on its inner diameter.

In this form downward movement of the piston 24 shears the pins 26 and 31 and drives the backup ring and seal into the annulus 27 to expand the seal against the stop 27 without the assistance of the protector ring 29.

Reference is now made to continuation views 5A and 5B which illustrate in detail a valve constructed in accordance with this invention.

The housing includes the tubular housing 33, the upper sub 34, and the lower sub 35.

The lower sub has extending upwardly therefrom the inner tubular member 36 which has a plurality of ports 37 extending therethrough at an intermediate portion of the tubular member 36.

The stop for limiting downward movement of the seal is provided by an outwardly extending shoulder 38 on the exterior of the tubular member.

The housing has a plurality of ports 39 positioned below the shoulder 38 for permitting flow of fluid from the exterior of the housing through the ports 39 into the annulus 41 between the housing and the tubular member 36.

A metallic seal 42 is provided between the housing and the upper section of the tubular member 36. This seal may be provided by a lead member and be backed up on its upper and lower surfaces by backup means indicated generally at 43 and 44. These backup members and the seal are shown in Setterberg U.S. Pat. No. 4,288,082, referred to hereinabove.

Below the seal assembly there is provided a releasable means for holding the seal in its first or upper position. This means may take the form of a collet indicated generally at 45 having fingers 46 which extend into a groove 47 in the housing to releasably support the seal assembly in its first position, as shown. To drive the seal downwardly and expand it against the shoulder 38 a piston 48 is provided which carries a sliding seal indicated generally at 49.

To releasably retain the piston 48 in the up position, the piston has an upward extension 48*a* which carries collet fingers 50 engageable in the groove 51 in the housing to releasably support the piston in the up position, as shown.

Preferably, after the seal has been expanded, it is held in expanded position by the piston 48. For this purpose the upper section 48*a* of the piston extension has the roughened outer surface 48*b* which is engaged by slips 52 urged upwardly along the inclined surface 53 of the slip bowl 54 by resilient means such as spring 55. The surface 48*b* may be a fine thread. Thus, as the piston moves to its down position the slips 52 engage the roughened surface 48*b* and lock the piston in its full down position.

To provide for pressurizing the form of piston illustrated, a catching tube or ring 56 is releasably secured to the piston by the shear pin 57. A seal 58 is provided between the piston and the catching ring.

At the upper end of the ring a seat 59 adapted to receive the ball 61 is provided.

In operation the valve is run in the hole in the condition illustrated and the operator may circulate through the valve to condition the fluid to be retained in the casing-tubing annulus. When desired the ball 61 is dropped into the tubing and seated on the seat 59 at which time the area of the piston defined by the exterior of seal 49 is now exposed to pressure within the tubing. With this large area a substantial force may be exerted on the piston to drive it downwardly. As the piston moves downwardly the collet fingers 50 release the piston from the housing and the piston moves the seal assembly downwardly releasing the collet fingers 46 in response to downward movement of the seal. This downward movement will occur as pressure is being built up in the tubing, but before a high pressure situation exists. The piston will drive the seal down until the backup ring 43 engages and is supported on the backup shoulder 38. At this time the upper and lower backup rings will operate in the manner taught in the Setterberg patent to provide full support above and below the metallic seal 42 to insure that the seal is confined between the back up rings and does not extruded therepast. As pressure builds up to the maximum the seal 42 will expand in the annulus and will engage the teeth 62 on the inner diameter of the housing and the teeth 63 on the outer diameter of the tube 36 and the metal seal member will flow into these teeth to provide a labyrinth type seal to further insure against leakage of fluid past the metallic seal.

As the piston moves down to its full seal expanding position the slips 52 will have been held in their engaging position by the spring 55 driving the slips against the inclined surface 53. The slips 52 will engage with the roughened surface **48*b* on the exterior of the piston extension and will lock the piston in its full down position to maintain the seal 42** under pressure.

After the seal is fully expanded an increase in pressure in the tubing will shear the pin 57 between the catcher and piston and the catcher and ball 61 may be pumped out through the bottom of the valve. Thereafter the valve is permanently closed and merely provides a portion of the tubing.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A valve comprising, a tubular housing, tube means having one end fixed in said housing and a section spaced radially inward from said housing to provide an annulus, port means in said housing communicating with said annulus, flowway means remote from said port means communicating said annulus with the interior of said tube means, stop means in said annulus, metallic seal means slidably carried in said housing and movable from a first position spaced from the annulus between said port means and flowway means and to a second position in said annulus between said port means and flowway means, piston means slidable in said housing for moving said seal means from said first to said second position and expanding said seal means against said stop means to prevent flow through said ports, and releasable means preventing sliding of said seal means and said piston means in said housing with said seal means in said first position.

2. A valve comprising, a tubular housing, tube means having one end fixed in said housing and a section spaced radially inward from said housing to provide an annulus, port means in said housing communicating with said annulus, flowway means remote from said port means communicating said annulus with the interior of said tube means, stop means in said annulus, metallic seal means slidably carried in said housing and movable from a first position spaced from the annulus between said port means and flowway means and to a second position in said annulus between said port means and flowway means, piston means slidable in said housing for moving said seal means from said first to said second position and expanding said seal means against said stop means to prevent flow through said ports, releasable means preventing sliding of said seal means and said piston means in said housing with said seal means in said first position, and an annular protector arranged internally of said seal means when in said first position.

3. A valve comprising, a tubular housing, tube means having one end fixed in said housing and a section spaced radially inward from said housing to provide an annulus, port means in said housing communicating with said annulus, flowway means remote from said port means communicating said annulus with the interior of said tube means, stop means in said annulus, metallic seal means slidably carried in said housing and movable from a first position spaced from the annulus between said port means and flowway means and to a second position in said annulus between said port means and flowway means, piston means slidable in said housing for moving said seal means from said first to said second position and expanding said seal means against said stop means to prevent flow through said ports, releasable means preventing sliding of said seal means and said piston means in said housing with said seal means in said first position, an annular protector arranged internally of said seal means when in said first position, and a catching member sized to pass through said tube means and sealingly and releasably secured to said piston, said member having a seat for catching and sealing with a plug dropped into said valve.

4. The valve of claim 2 or 3 wherein said annular protector is an extension of said tube means and said flowway means is provided by holes through said extension.

5. The valve of claim 2 or 3 wherein said protector moves with said seal means and engages said tube means and provides a continuation thereof just prior to movement of the seal means into said annulus.

6. The valve of claim 1, 2 or 3 wherein said releasable means is provided by separate releasable means for each of the seal means and piston means.

7. The valve of claim 1, 2 or 3 wherein means are provided for latching the piston against said seal means with the seal means in said second position.

8. The valve of claim 1, 2 or 3 wherein teeth are provided on the interior of said housing and on the exterior of said tube means and are engaged by said seal means when in said second position to provide a labyrinth-type seal therebetween.

* * * * *